US008803052B2

(12) United States Patent
Schorr et al.

(10) Patent No.: US 8,803,052 B2
(45) Date of Patent: Aug. 12, 2014

(54) PREDICTIVE ROLL CAPTURE

(75) Inventors: David Schorr, Austin, TX (US); James H. Steenson, Jr., New Boston, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 354 days.

(21) Appl. No.: 13/377,006

(22) PCT Filed: Apr. 8, 2011

(86) PCT No.: PCT/US2011/031668

§ 371 (c)(1), (2), (4) Date: Dec. 8, 2011

(87) PCT Pub. No.: WO2011/127338

PCT Pub. Date: Oct. 13, 2011

(65) Prior Publication Data

US 2012/0080553 A1 Apr. 5, 2012

Related U.S. Application Data

(60) Provisional application No. 61/321,908, filed on Apr. 8, 2010.

(51) Int. Cl.

| | |
|---|---|
| ***F42B 10/54*** | (2006.01) |
| ***F42B 15/01*** | (2006.01) |
| ***F42B 10/26*** | (2006.01) |
| *F42B 10/00* | (2006.01) |
| *F42B 15/00* | (2006.01) |

(52) U.S. Cl.

CPC ..... *F42B 10/26* (2013.01)

USPC ..... 244/3.23; 244/3.1; 244/3.15

(58) Field of Classification Search

CPC ..... F42B 10/54

USPC ..... 244/3.1–3.3, 175, 177, 179

See application file for complete search history.

(56) References Cited

U.S. PATENT DOCUMENTS

| | | | | | |
|---|---|---|---|---|---|
| 4,674,705 | A | * | 6/1987 | Schleicher | 244/3.1 |
| 4,715,282 | A | * | 12/1987 | Rosenberg et al. | 244/3.29 |
| 5,023,796 | A | * | 6/1991 | Kahler | 244/179 |
| 5,058,836 | A | * | 10/1991 | Nobel | 244/3.15 |
| 5,062,583 | A | * | 11/1991 | Lipps et al. | 244/3.15 |
| 5,088,658 | A | * | 2/1992 | Forsmo | 244/3.21 |
| 5,094,406 | A | * | 3/1992 | Shafer | 244/3.21 |
| 5,253,588 | A | * | 10/1993 | Vogt et al. | 244/3.3 |
| 5,386,951 | A | * | 2/1995 | Gaywood | 244/3.22 |
| 6,616,093 | B1 | * | 9/2003 | Albrektsson et al. | 244/3.23 |
| 6,883,747 | B2 | | 4/2005 | Ratkovic et al. | |
| 6,923,404 | B1 | | 8/2005 | Liu et al. | |
| 2008/0315032 | A1 | | 12/2008 | Harnoy | |

FOREIGN PATENT DOCUMENTS

| | | | | | |
|---|---|---|---|---|---|
| WO | 8201745 | | 5/1982 | | |
| WO | WO2011/127338 | A2 | * 10/2011 | | F42B 10/54 |
| WO | WO2011/127338 | A3 | * 10/2011 | | F42B 10/54 |

* cited by examiner

*Primary Examiner* — Bernarr Gregory

(74) *Attorney, Agent, or Firm* — Maine Cernota & Rardin; Daniel J. Long

(57) ABSTRACT

A method for controlling autopilot roll capture of a rocket comprising adapting the start time and the rate of roll capture such that regardless of the initial rocket spin rate, the roll capture process is completed at a predetermined time.

17 Claims, 5 Drawing Sheets

PREDICTIVE ROLL CAPTURE

RELATED APPLICATIONS

This application claims the benefit of U.S. Provisional Application No. 61/321,908, filed Apr. 8, 2010. That application is herein incorporated by reference in its entirety for all purposes.

STATEMENT OF GOVERNMENT INTEREST

Portions of the present invention may have been made in conjunction with Government funding under contract number W31P4Q-06-C-0330, and there may be certain rights to the Government.

FIELD OF THE INVENTION

The invention relates to rocket and missile guidance and control, and more particularly, to autopilot predictive roll capture.

BACKGROUND OF THE INVENTION

Due to limitations inherent in the rocket manufacturing process, among other reasons, the thrust vector of a rocket can never be perfectly aligned with the longitudinal axis of the rocket. This results in a thrust misalignment that generates asymmetrical forces on the rocket causing unwanted pitch and yaw attitude changes which have adverse effects on the flight trajectory and decrease the probability of target interception.

A solution to this problem is to impart a spin to the rocket motor during the boost phase which mitigates the effect of these asymmetrical forces and other lateral body movements. The spin may be imparted by fluting at the base of the rocket motor which converts some of the downward thrust to rotational torque.

Some guidance strategies require the rocket to be de-spun, before guidance initiation starts at about the time that the rocket motor burns out. The process for de-spinning the rocket is called autopilot roll capture and it is typically initiated at a fixed time after launch to insure the process is completed at a later fixed time to handle the worst case scenario (longest de-spin time) which occurs at high altitudes and low speeds.

Unfortunately, at lower altitudes and/or launches from high speed platforms, the de-spin process completes in a shorter period of time due to the greater aerodynamic forces which results in a de-spun rocket while the rocket motor is still providing thrust. Rocket motor thrust misalignment in this situation can severely impact the rocket trajectory and decrease the probability of intercept.

What is needed, therefore, are techniques for adaptively controlling the roll capture process so that the rocket is de-spun at the optimal time.

SUMMARY OF THE INVENTION

A goal of the present invention is to maintain rocket spin for as long as possible to mitigate the effects of asymmetrical forces that cause unwanted attitude changes that result in flight path angle errors.

One embodiment of the present invention provides a method and apparatus for controlling autopilot roll capture of a rocket by adapting the start time and the rate of roll capture such that regardless of the initial rocket spin rate, the roll capture process is completed at a predetermined time which may be selected to coincide with the time of motor burnout.

Another embodiment of the present invention provides for closing the Roll, Pitch and Yaw control loops when the rocket spin rate has decreased below a predetermined threshold.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The invention is susceptible to many variations. Accordingly, the drawings and following description of various embodiments are to be regarded as illustrative in nature, and not as restrictive.

Since the thrust vector of a rocket is never perfectly aligned with the longitudinal axis of the rocket, thrust misalignment may be generated, causing unwanted pitch and yaw attitude changes that have adverse effects on the flight trajectory and decrease the probability of target interception. This problem may be mitigated by imparting a spin to the rocket while the rocket is under thrust. The rocket needs to be de-spun, however, before guidance initiation may start, at about the time that the rocket motor burns out.

The process for de-spinning the rocket, called autopilot roll capture, involves deploying flaperons or other guidance control surfaces on the rocket. The flaperons, which are a combination of ailerons and flaps, cause the rocket to undergo spin deceleration, or de-roll, through the force of directed air resistance.

Rocket de-roll is more effective at lower altitudes, where atmospheric pressure is greater, and at higher speeds, where the forces imparted to the guidance control surfaces are greater. For these and other reasons, selecting a fixed roll capture start time may result in variable completion times. This, in turn, may result in the rocket being de-spun before motor burnout, causing trajectory or flight path angle errors.

An object of the invention is to provide a method and apparatus for controlling autopilot roll capture of a rocket by adapting the start time and the rate of roll capture such that regardless of the initial rocket spin rate, the roll capture process is completed at a predetermined time which may be selected to coincide with the time of motor burnout.

Figure 1:
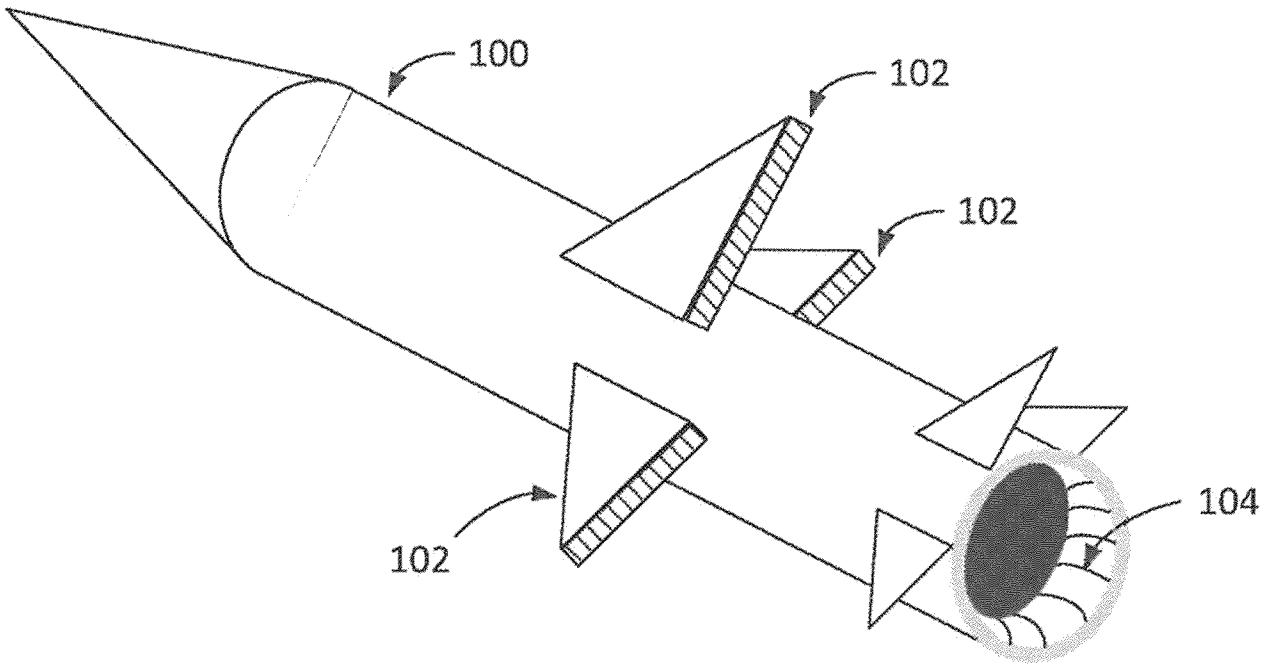
FIG. 1 is a perspective view of a rocket under thrust configured in accordance with one embodiment of the present invention.

Referring now to FIG. 1 which shows a perspective view of a rocket under thrust configured in accordance with one embodiment of the present invention. The rocket 100 may be configured with some number of flaperons 102 around the mid-section of the rocket body. There are typically four flaperons 102, three of which are shown in the figure, the fourth hidden below the rocket body. Fluting 104 is shown at the tail of the rocket motor which directs a portion of the rocket thrust tangentially to the longitudinal axis of the rocket to impart a spin to the rocket while the motor is thrusting.

Figure 2:
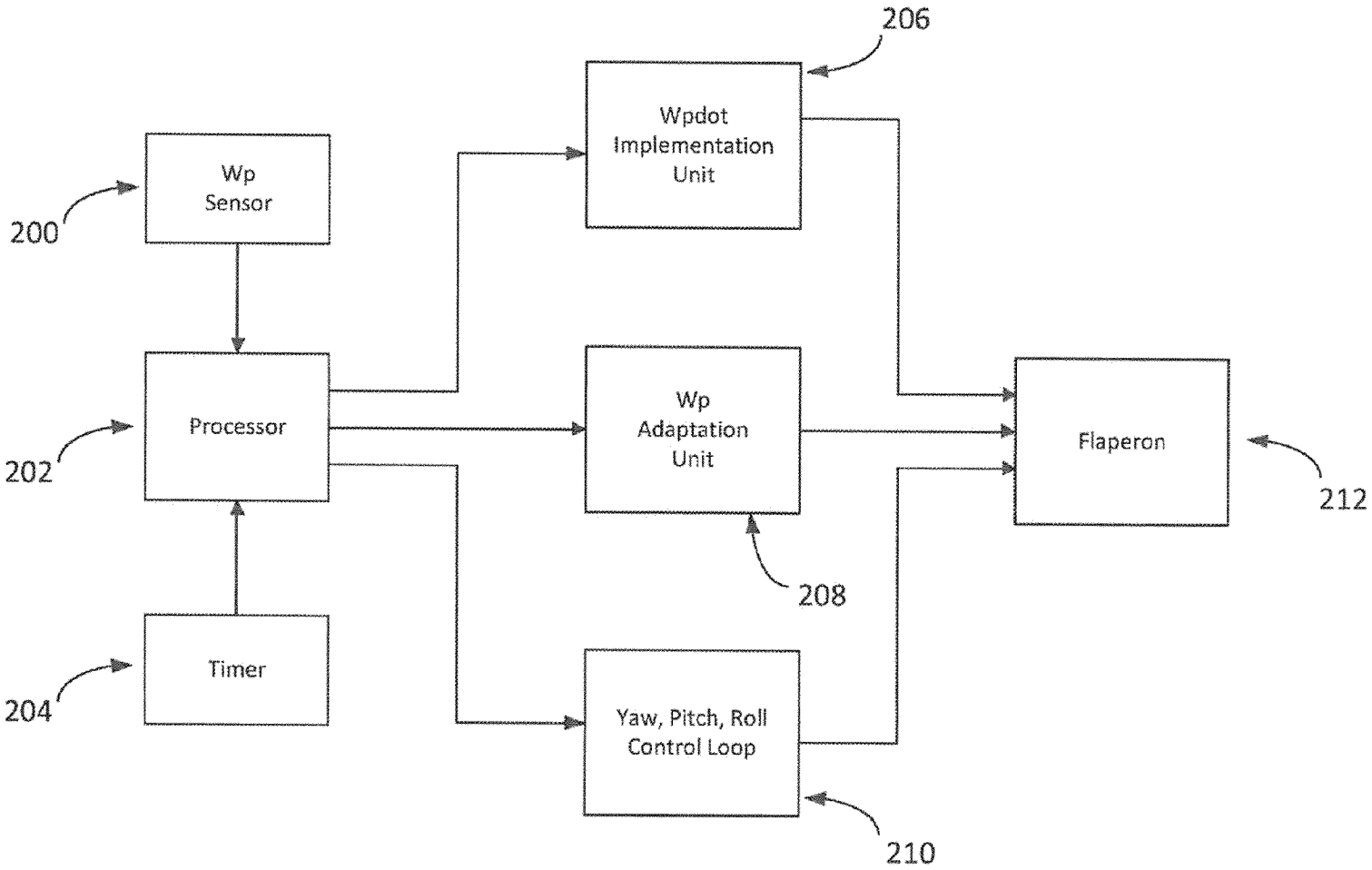
FIG. 2 is a block diagram illustrating an autopilot predictive roll capture system configured in accordance with one embodiment of the present invention.

Referring now to FIG. 2 which shows a block diagram illustrating an autopilot predictive roll capture system configured in accordance with one embodiment of the present invention. Wp sensor 200 monitors the current spin rate, Wp, and feeds this information to processor 202. Processor 202 calculates a roll capture start time based on Wp, a selected spin rate deceleration, Wpdot, and a predetermined roll capture completion time which may be chosen to coincide with the time of rocket motor burnout. Timer 204 allows processor 202 to wait until the current time reaches the calculated roll capture start time, at which point processor 202 enables Wpdot implementation unit 206 to cause the rocket to achieve the selected spin rate deceleration. Wpdot implementation unit 206 accomplishes this by controlling Flaperons 212 which are capable of being set to a continuously adjustable angle as necessary for achieving the required spin rate deceleration.

A Wp adaptation unit 208 periodically adapts the selected spin rate based on monitoring of the current spin rate by Wp sensor 200. The adaptation is directed to achieving the predetermined roll capture completion time. Periodically adapted roll rate commands (Wp Commands) are issued as a function of time to achieve a roll rate ramping towards zero with a fixed slope of WpDot. A roll rate control loop uses these ramp profiled Wp Commands as an input and attempts to control the airframe to the profiled command. The roll rate control loop handles the variation in effort that is required to achieve the ramped Wp command.

Once the spin rate falls below a predetermined threshold, processor 202 closes the Yaw, Pitch and Roll Control Loops 210. These control loops may be employed to achieve predetermined target pitch and yaw attitudes.

It should be understood that any or all of blocks labeled Timer 204, Wpdot implementation unit 206, Wp adaptation unit 208, and Yaw, Pitch and Roll Control Loops 210 may be implemented within Processor 202 or as separate functional blocks.

Figure 3:
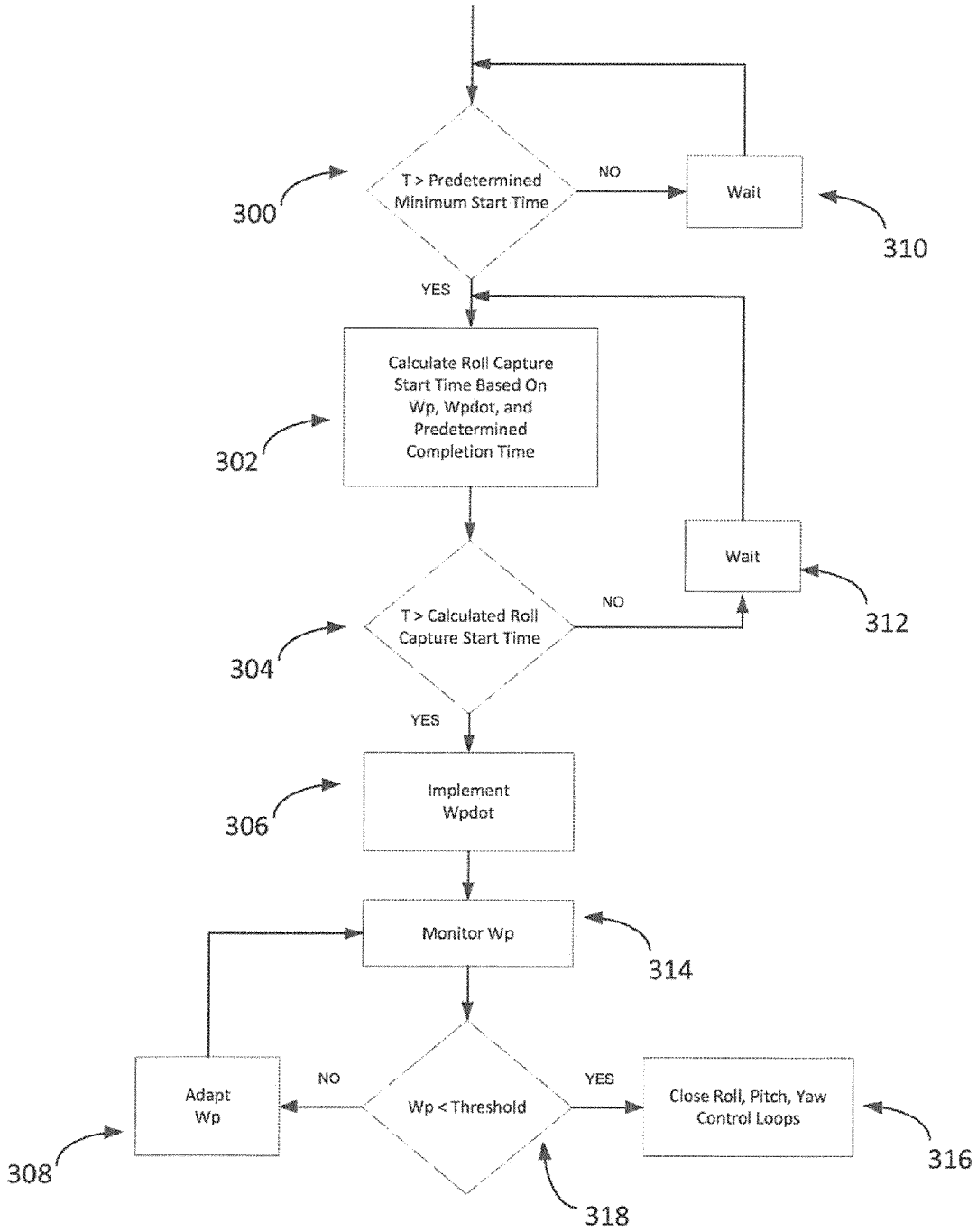
FIG. 3 is a flowchart illustrating a method of performing an autopilot predictive roll capture in accordance with one embodiment of the present invention.

Referring now to FIG. 3 which shows a flowchart illustrating a method of performing an autopilot predictive roll capture in accordance with one embodiment of the present invention. The method begins at step 300 by determining if the current time has reached a predetermined minimum start time and, if not, waiting at step 310 until the minimum start time is reached. The predetermined minimum start time may be an arbitrary time chosen such that systems have been initialized and any necessary data is available for processing.

Next, at step 302, the roll capture start time is calculated based upon the current spin rate, Wp, a selected spin rate deceleration, Wpdot, and a predetermined roll capture completion time which may be chosen to coincide with the time of rocket motor burnout. At step 304, if the current time has not yet reached the calculated roll capture start time, the method waits at step 312 and updates the calculated roll capture start time based upon the sensor data until the calculated roll capture start time has been reached. Once the calculated roll capture start time has been reached, step 306 implements the spin rate deceleration, Wpdot, by issuing spin rate commands (Wp Commands) which ultimately deploy the flaperons at the necessary angle.

At step 314, the spin rate is monitored and if the spin rate has not yet decreased below a predetermine threshold the spin rate is adapted as necessary, in step 308, to achieve the predetermined roll capture completion time.

At step 318, when the spin rate has decreased below a predetermined threshold, step 316 closes the Roll, Pitch and Yaw control loops. These control loops may be employed to achieve pre-determined target pitch and yaw attitudes.

Figure 4:
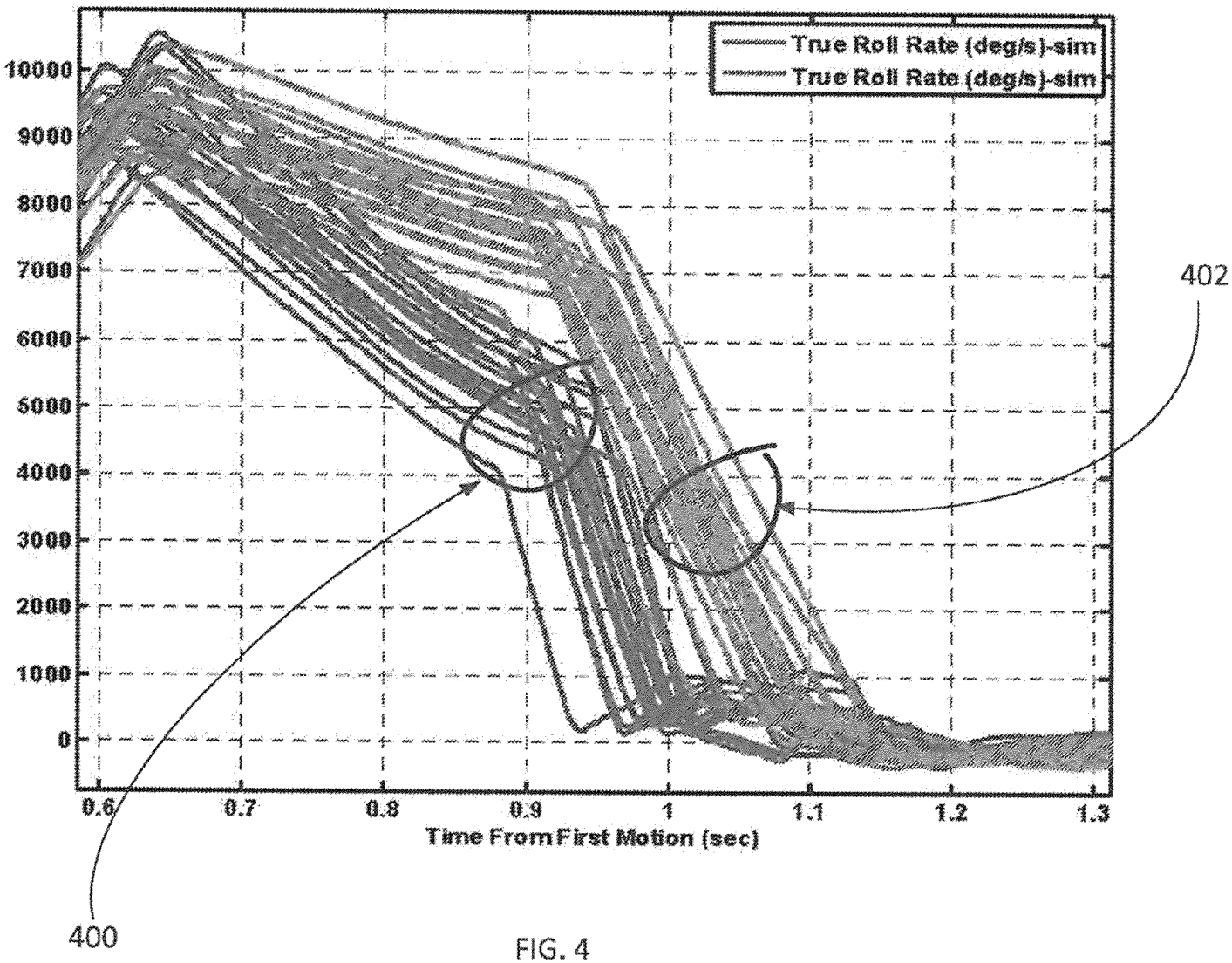
FIG. 4 is a graph illustrating spin rates as a function of time under the prior art.

Referring now to FIG. 4 which shows a graph illustrating spin rates as a function of time under the prior art. In this scenario the desired roll capture completion time is 1.1 second which corresponds to the rocket motor burnout time of a particular type of missile. Under the prior art a fixed roll capture start time of 0.9 seconds was selected so that the desired completion time of 1.1 seconds would be achieved in all cases including the worst case scenario of high altitude low speed flight where lower air density and lower speed results in slower deceleration.

As can be seen in the graphs, the high altitude cases 402 took longer to decelerate and achieved a completion time close to 1.1 seconds. The low altitude cases 400, however, decelerated more rapidly and achieved their completion time at less than 1.0 seconds. This resulted in 100 ms or more of de-spun missile flight during which the rocket motors were still thrusting. This in turn causes undesirable errors in flight path trajectory.

Figure 5:
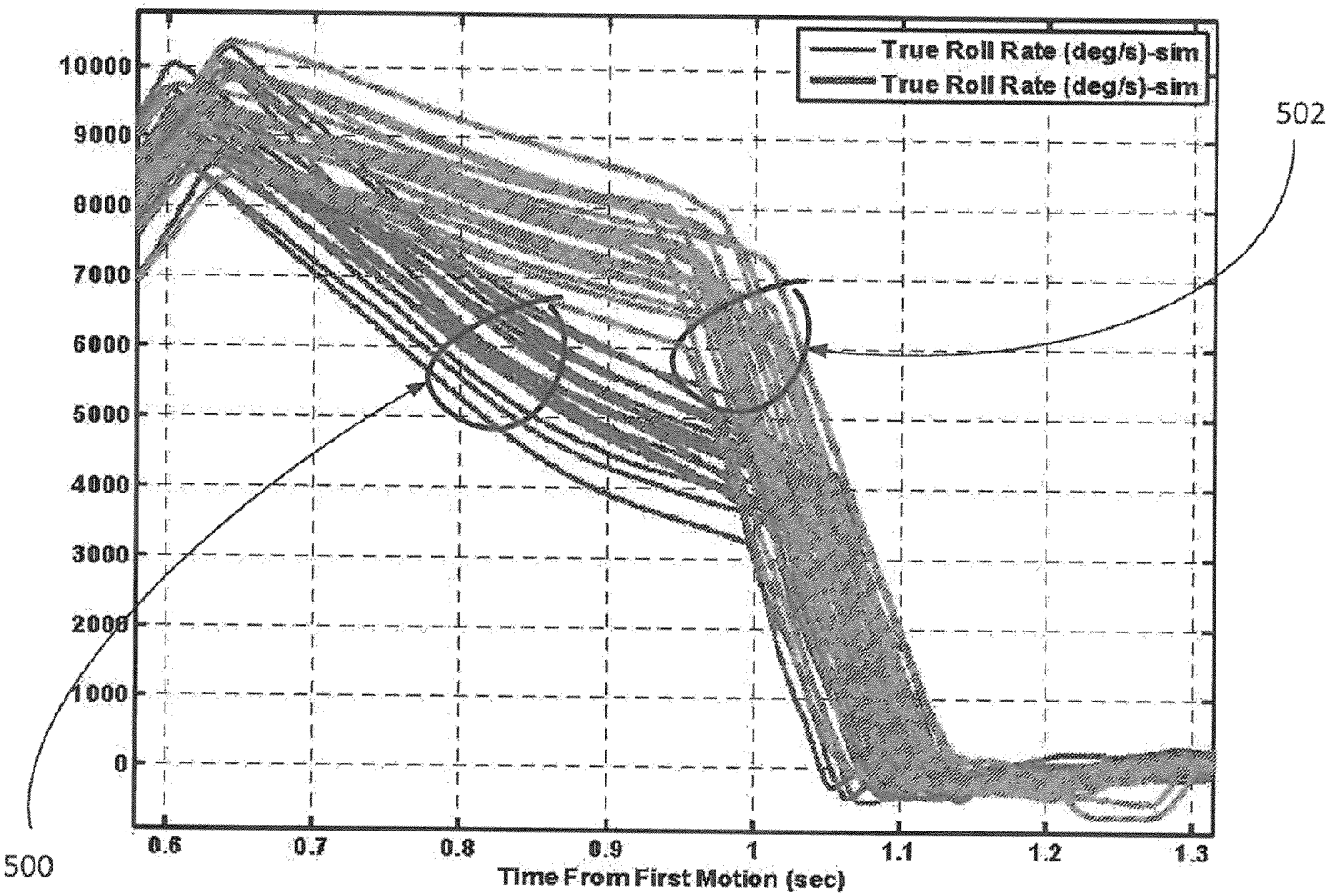
FIG. 5 is a graph illustrating spin rates as a function of time in accordance with one embodiment of the present invention.

Referring now to FIG. 5 which shows a graph illustrating spin rates as a function of time in accordance with one embodiment of the present invention. In this case a fixed roll capture start time is abandoned in favor of a calculated roll capture start time in combination with a dynamic adaptation of the spin rate. As can be seen in the graphs, the low altitude cases 500 are subject to start times that are delayed relative to the high altitude cases 502 with the result that all cases achieve a roll capture completion time closer to the desired 1.1 seconds and minimizing resultant flight path trajectory errors.

As will be realized, the invention is capable of other and different embodiments, and its several details are capable of modifications in various obvious respects, all without departing from the essence of the invention. For instance, the invention may be practiced as an apparatus and/or process, and can be scaled. There is within the scope of the invention, a method for controlling autopilot roll capture of a rocket comprising calculating a start time for de-spin of the rocket and adapting a rate of de-spin of the rocket such that regardless of an initial rocket spin rate, the roll capture process completes at a predetermined time based on the calculated start time and the adapted rate of de-spin. The rate of spin may be adapted by adjusting an angle of a flaperon on the rocket. When the current spin rate of the rocket is below a predetermined threshold, control loops for roll, pitch and yaw of the rocket may be closed. The predetermined completion time may be chosen to coincide with the rocket motor burnout.

There is further within the scope of the invention, a method for controlling autopilot roll capture of a rocket comprising calculating a roll capture start time based on the current spin rate, a selected spin rate deceleration and a predetermined roll capture completion time. When the calculated roll capture start time arrives the selected spin rate deceleration may be implemented and the spin rate may be monitored. The spin rate may be periodically adapted based on the monitoring to achieve the predetermined roll capture completion time. The selection of the spin rate deceleration may be based on spin rate sensor constraints. A flaperon on the rocket may be deployed at an angle necessary to achieve the spin rate deceleration. The method may not commence until a predetermined minimum start time.

There is further within the scope of the invention, an autopilot roll capture apparatus for a rocket comprising a processor to calculate a roll capture start time based on a current spin rate, a selected spin rate deceleration and a predetermined roll capture completion time; a timer to wait for the calculated roll capture start time; an implementation unit to achieve the selected spin rate deceleration; a sensor to monitor the spin rate; and an adaptation unit to periodically adapt the selected spin rate based on the monitoring to achieve the predetermined roll capture completion time. The apparatus may additionally comprise a control loop for yaw, pitch and roll of the rocket, to be closed after the spin rate falls below a predetermined threshold. The apparatus may additionally comprise a flaperon capable of being sent to a continuously adjustable angle as necessary to achieve the spin rate deceleration.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A method for controlling autopilot roll capture of a rocket comprising:

calculating a start time for de-spin of the rocket; and implementing a rate of de-spin of the rocket such that regardless of an initial rocket spin rate, the roll capture process completes at a predetermined time based on the calculated start time and the implemented rate of de-spin.

2. The method of claim 1 wherein the implementing of the rate of de-spin is accomplished by adjusting an angle of a flaperon on the rocket.

3. The method of claim 1 further comprising adapting the spin rate by adjusting the angle of the flaperon on the rocket.

4. The method of claim 1 further comprising:

determining that a current spin rate of the rocket is below a predetermined threshold; and closing control loops for roll, pitch and yaw of the rocket in response to the determination.

5. The method of claim 1 wherein the predetermined roll capture completion time coincides with rocket motor burnout.

6. A method for controlling autopilot roll capture of a rocket comprising the steps, where T is current time, Wp is current spin rate, and Wpdot is spin rate deceleration:

calculating a roll capture start time based on Wp, a selected Wpdot and a predetermined roll capture completion time;

waiting for T to reach the calculated roll capture start time;

implementing the selected Wpdot; and monitoring Wp.

7. The method of claim 6 further comprising periodically adapting the Wp based on the monitoring to achieve the predetermined roll capture completion time.

8. The method of claim 6 further comprising closing control loops for roll, pitch and yaw of the rocket after Wp falls below a predetermined threshold.

9. The method of claim 6 wherein the selection of Wpdot is based on spin rate sensor constraints.

10. The method of claim 6 wherein a flaperon is deployed on the rocket at an angle necessary to achieve Wpdot.

11. The method of claim 6 wherein the method does not begin until T exceeds a predetermined minimum start time.

12. The method of claim 6 wherein the predetermined roll capture completion time coincides with rocket motor burnout.

13. An autopilot roll capture apparatus for a rocket comprising the steps, where T is current time, Wp is current spin rate, and Wpdot is spin rate deceleration:

a processor to calculate a roll capture start time based on Wp, a selected Wpdot and a predetermined roll capture completion time;

a timer to wait for T to reach the calculated roll capture start time;

an implementation unit to achieve the selected Wpdot; and a sensor to monitor Wp.

14. The autopilot roll capture apparatus of claim 13 further comprising an adaptation unit to periodically adapt the Wp based on the monitoring to achieve the predetermined roll capture completion time.

15. The autopilot roll capture apparatus of claim 13 further comprising a control loop for yaw, pitch and roll of the rocket, to be closed after Wp falls below a predetermined threshold.

16. The autopilot roll capture apparatus of claim 13 further comprising a flaperon capable of being set to a continuously adjustable angle as necessary to achieve Wpdot.

17. The autopilot roll capture apparatus of claim 13 wherein the predetermined roll capture completion time coincides with rocket motor burnout.

* * * * *